US005499678A

United States Patent [19]

Surjaatmadja et al.

[11] Patent Number: 5,499,678

[45] Date of Patent: Mar. 19, 1996

[54] COPLANAR ANGULAR JETTING HEAD FOR WELL PERFORATING

[75] Inventors: Jim B. Surjaatmadja; Timothy W. Helton; Hazim H. Abass, all of Duncan, Okla.

[73] Assignee: Halliburton Company, Duncan, Okla.

[21] Appl. No.: 284,961

[22] Filed: Aug. 2, 1994

[51] Int. Cl.[6] ..... E21B 43/114

[52] U.S. Cl. ..... 166/298; 166/308; 166/55

[58] Field of Search ..... 166/298, 308, 166/55, 222

[56] References Cited

U.S. PATENT DOCUMENTS

| | | | |
|---|---|---|---|
| 3,393,736 | 7/1968 | Goodwin | 166/298 X |
| 4,050,529 | 9/1977 | Tagirov et al. | 166/298 X |
| 4,673,312 | 6/1987 | Nussbaumer | 405/184 |
| 4,768,709 | 9/1988 | Yie | 239/8 |
| 4,787,465 | 11/1988 | Dickinson, III et al. | 175/67 |
| 4,818,197 | 4/1989 | Mueller | 418/48 |
| 4,930,586 | 6/1990 | Turin et al. | 175/25 |
| 4,949,788 | 8/1990 | Szarka et al. | 166/285 |
| 4,979,561 | 12/1990 | Szarka | 166/240 |
| 4,991,653 | 2/1991 | Schwegman | 166/312 |
| 4,991,654 | 2/1991 | Brandell et al. | 166/332 |
| 4,991,667 | 2/1991 | Wilkes, Jr. et al. | 175/61 |
| 5,029,644 | 7/1991 | Szarka et al. | 166/223 |
| 5,097,902 | 3/1992 | Clark | 166/187 |
| 5,174,340 | 12/1992 | Peterson et al. | 138/110 |
| 5,335,724 | 8/1994 | Verditto et al. | 166/298 |

FOREIGN PATENT DOCUMENTS

| | | | |
|---|---|---|---|
| 1314023 | 5/1987 | Russian Federation | 166/298 |

OTHER PUBLICATIONS

Halliburton Services Sales & Service Catalog No. 43, p. 2575 (1985).

*Primary Examiner*—William P. Neuder
*Attorney, Agent, or Firm*—Stephen R. Christian; Neal R. Kennedy

[57] ABSTRACT

A coplanar jetting head for well perforating. The apparatus comprises a housing defining a plurality of jetting openings therein. The jetting openings are substantially coplanar and are angularly disposed with respect to a longitudinal axis of the housing. Each of the jetting openings has a jetting nozzle disposed therein. In the preferred embodiment, the angle of the plane of the jetting openings is such that the plane may be positioned substantially perpendicular to an axis of least principal stress in a well formation adjacent to the well bore when the housing is disposed in the well bore. A method of fracturing a well is also disclosed and comprises the steps of positioning a jetting head in a well bore and directing a plurality of fluid jets from the jetting head at an angle with respect to the longitudinal axis of the well bore.

15 Claims, 4 Drawing Sheets

COPLANAR ANGULAR JETTING HEAD FOR WELL PERFORATING

BACKGROUND OF THE INVENTION

1. Field of the Invention

This invention relates to apparatus and methods for perforating wells, and more particularly, to a jetting head with a plurality of coplanar jets which are used to penetrate the well casing.

2. Description of the Prior Art

There are a number of methods used in perforating wells which are well known. The present invention overcomes problems associated with these prior methods and provides an apparatus and method which is particularly well suited for, but not limited to, the special situations which are presented in the completion of deviated wells. A brief discussion of several different techniques currently used for the completion of deviated wells follows.

A first, very common manner of completing a deviated well is to case and cement the vertical portion of the well and to leave the deviated portion of the well which runs through the production formation as an open hole, i.e., without any casing in place therein. Hydrocarbon fluids in the formation are produced into the open hole and then through the casing in the vertical portion of the well. The problem with this is there is no case to prevent collapse of the well bore.

A second technique which is commonly used for the completion of deviated wells is to place a length of slotted casing in the deviated portion of the well to prevent the open hole from collapsing. A gravel pack may be placed around the slotted casing. The slotted casing may run for extended lengths through the formation, for example, as long as one mile.

A third technique which is sometimes used to complete deviated wells is to cement casing in both the vertical and deviated portions of the well and then to provide communication between the deviated portion of the casing and the producing formation by means of perforations or casing valves. The formation may also be fractured by creating fractures initiated at the location of the perforations or the casing valves.

In this technique, the formation of perforations is often done using shaped charge methods. That is, explosive charges are carried by a perforating gun, and these explosive charges create holes which penetrate the side wall of the casing and penetrate the cement surrounding the casing. Typically, the holes will be in a pattern extending over a substantial length of the casing.

A problem with the use of explosive charges to perforate is that this method generally creates high damage in the formation by increasing skin and also creating high localized stresses in the formation. By doing this, fractures created by stimulation processes tend to become very tortuous and restrict the production of oil and gas. This problem of tortuosity, literally meaning "marked by repeated twists and bends" reduces the potential production rate of the well because even though the rock moves to open the fracture, severe restrictions still remain.

Tortuosities thus are generally caused by the situation wherein the initial fracture does not coincide with the maximum stress plane. Under such a circumstance, the fracture will twist or bend to finally direct itself to the maximum stress plane. This can be caused by incorrect fracture initiation procedures or high localized stresses which prevent the fracture from initiating properly. An additional problem closely associated with tortuosity is the creation of multiple fractures which will increase leakoff and hence cause screenouts.

When the communication between the casing and production formation is provided by casing valves, those valves may be like those seen in U.S. Pat. No. 4,949,788 to Szarka, et al., U.S. Pat. No. 4,979,561 to Szarka, U.S. Pat. No. 4,991,653 to Schwegman, U.S. Pat. No. 5,029,644 to Szarka et al., and U.S. Pat. No. 4,991,654 to Brandell et al., all assigned to the assignee of the present invention. Such casing valves also provide a large number of radial bore type openings communicating the casing bore with the surrounding formation.

When utilizing either perforated casing or casing valves like those described, fracturing fluid enters the formation through a large multitude of small radial bores at a variety of longitudinal positions along the casing, and there is no accurate control over where the fracture will initiate and in what direction the fracture will initiate. As mentioned, this lack of proper fracture initiation results in tortuosity.

Fracture initiation is largely influenced by the shape and orientation of the initial cavity, maximum and minimum stress direction, near well bore conditions such as localized stresses, or other irregularities that may be encountered such as natural fractures, fossils, etc.

To solve the problems of these prior methods, hydrajetting has been developed. Generally, hydrajetting does not result in skin damage, and no residual stresses occur since jetting is performed at pressures below the yield strength of the rock. Moreover, the jetting tool is positioned in the correct direction for proper fracture initiation. Thus, tortuosities are reduced or eliminated. This is because in hydrajetting, holes are formed by removal of material, rather than compaction. Removal is performed below the compressive strength of the rock, and thus there is no highly stressed area formed. Further, hydrajetting is a slower process. Therefore, temporary deflection or reflection by abnormal positioning will not jeopardize the quality of the cutting process. The main intent of hydrajetting perforating is to be able to position a cavity such that the shape is basically flat and located in the direction of maximum principal stress. By doing this, fractures will start at the edges of such cavities, and tortuosities will therefore not occur.

Examples of hydrajetting perforating tools are disclosed in U.S. Pat. Nos. 5,249,628 and 5,325,923 and U.S. Pat. application Ser. No. 08/206,560, all of which are assigned to the assignee of the present invention. Each of these discloses apparatus and techniques designed to create a cavity which promotes fractures to initiate perpendicular to the well bore, thus being particularly suitable for deviated wells or very shallow vertical wells. These devices are designed for wells drilled in the direction of least principal stress and to create a cavity perpendicular to the well bore.

Jetting parallel to the casing also may be done and involves the movement of the jetting tool up and down the casing. In order to make a cut which is sufficiently deep, the jetting tool must move at a very slow speed. To introduce a good slot in deviated wells, an in-line, multiple jet system must be used.

While such hydrajetting tools substantially reduce the problem of tortuosities in the fractures, tortuosity can still be a problem. This is due to the fact that many operators place their holes randomly, and thus initiate fractures which are uncontrolled. The apparatus and method of the present invention are designed to solve these previous problems by placing the perforations in one plane which is preferably perpendicular to the least principal stress. This is accomplished by placing jets coplanarly and positioning them such that the jets make a cutting angle that is at the steepest possible angle at the contact point in the casing. This improves cutting efficiency through the casing wall.

SUMMARY OF THE INVENTION

The present invention includes an apparatus and method for jetting a plurality of coplanar fluid jets. The apparatus and method are used for well perforating and provide such perforation with a minimum of tortuosity problems in the fractured well formation.

The jetting apparatus of the present invention comprises a housing defining a plurality of jetting openings therein. The jetting openings are preferably substantially coplanar and are angularly disposed with respect to a longitudinal axis of the housing. Each of the openings has a removable jetting nozzle disposed therein. Each jetting nozzle has an orifice, and jetting nozzles with one orifice size are interchangeable with jetting nozzles having different orifice sizes.

The angle of the plane in which the jetting openings are disposed is preferably such that the plane may be positioned substantially perpendicular to an axis of the least principal stress in a well formation adjacent to the well bore when the housing is disposed in the well bore.

In one embodiment, the openings are substantially radially oriented. That is, they are oriented in directions which substantially originate from, and therefore intersect, the longitudinal axis of the housing.

In another embodiment, at least some of the openings are oriented and originate from a direction spaced from the longitudinal axis. At least some of the openings in this second embodiment may be substantially parallel.

However, the invention is not intended to be limited to one with only parallel openings. Thus, in still another embodiment, the nozzles are evenly angularly disposed around the housing of the jetting apparatus, and the nozzles generally face to one side. However, the nozzles diverge slightly at angles which can be calculated as functions of the cut angle through the fracture formation, the outside diameter of the jetting tool, and the inside diameter of the casing string. This third embodiment is similar to the second embodiment, except that the nozzles are not parallel. A preferred orientation of the jetting openings is such that they are at the steepest possible angle at the contact point of the jetted fluid in the well bore.

The present invention also includes a method of fracturing a well formation comprising the steps of positioning a jetting head in a well bore and directing a plurality of coplanar fluid jets from the jetting head at an angle with respect to a longitudinal axis of the well bore. Basically, the method is carried out using the apparatus described.

Numerous objects and advantages of the invention will become apparent as the following detailed description of the preferred embodiment is read in conjunction with the drawings which illustrate such embodiment.

BRIEF DESCRIPTION OF THE DRAWINGS

FIG. 6 illustrates a third embodiment of the invention shown in position in a substantially horizontal portion of a deviated well.

DESCRIPTION OF THE PREFERRED EMBODIMENT

Figure 1:
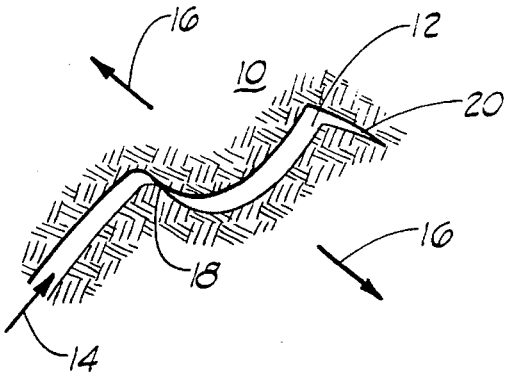
FIG. 1 PRIOR ART
FIG. 1 illustrates a well formation exhibiting the problem of tortuosity.

Referring now to the drawings, and more particularly to FIG. 1, the phenomenon of tortuosity in a well formation will be discussed. A subterranean well formation 10 is shown with a fracture 12. Fracture 12 provides a flow path as shown by arrow 14 and is created by rock movement indicated by arrows 16.

Tortuosity occurs when the flow path is twisted or has bends which can result in the flow path being at least partially closed off by restrictions, such as 18 and 20. It will be seen in such instances that even as the rock opens the fracture, restrictions 18 and 20 still remain. This reduces the potential production rate of the well.

Tortuosities are normally caused by the situation where the initial fracture does not coincide with a maximum stress plane. Under such a circumstance, the fracture will twist or bend to finally direct itself to the maximum stress plane. As previously mentioned, this is generally caused by incorrect fracture initiation procedures for high localized stresses which prevent proper fracture initiation.

Figure 2:
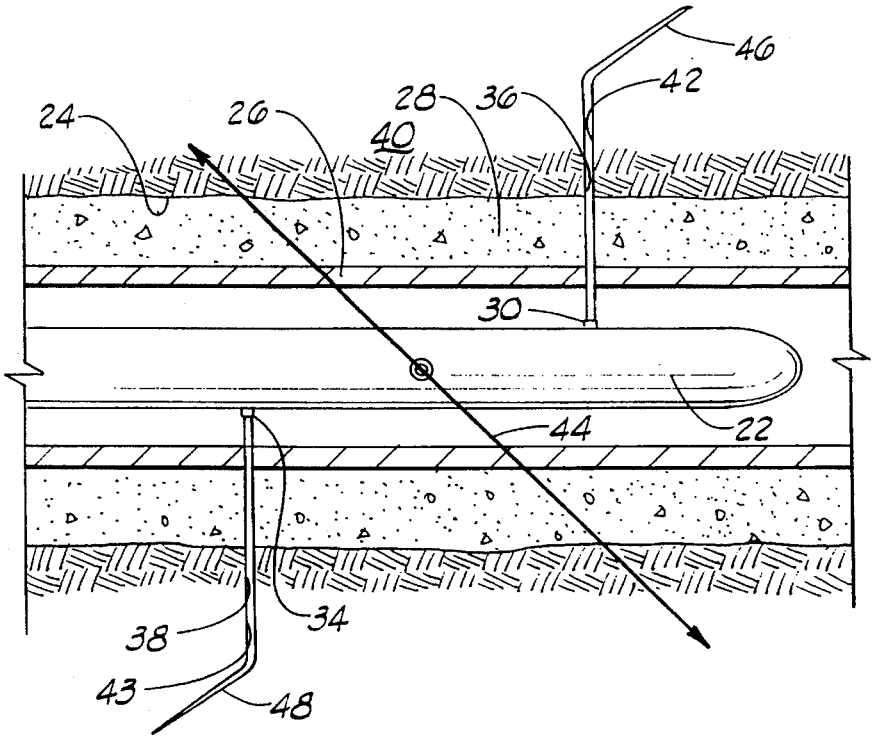
FIG. 2 PRIOR ART
FIG. 2 shows a prior art hydrajetting tool using jets perpendicular to the axis of the tool.

In the hydrajetting tools of the prior art, no real attempt has been made to align the jetting with the plane of maximum stress. For example, referring to FIG. 2, a prior art jetting tool 22 is illustrated in a well bore 24. Well bore 24 has a casing string 26 disposed therein and cemented in place by cement 28.

Tool 22 comprises a plurality of jetting nozzles, such as jetting nozzles 30, 32 and 34, which are disposed perpendicular to the longitudinal axis of tool 22.

Jetting with such a prior art tool 22 provides a plurality of jetted holes, such as holes 36 and 38, which are also perpendicular to the axis of well bore 24. The jetting nozzles jet these holes through casing string 26, cement 28 and into formation 40. Such radial holes will cause fractures to initiate and initially propagate outwardly in radial planes, such as indicated at 42 and 43, and will then turn in a direction generally perpendicular to the least principal stress axis 44 as indicated at 46 and 48, respectively. This type of jetting results in holes which are not in the same plane, so multiple fractures will occur. These multiple fractures and the turning to the direction generally perpendicular to the least principal stress axis 44 can result in tortuosity, although it is generally not as severe a problem with jetted holes as with perforations using explosive charges.

Figure 3:
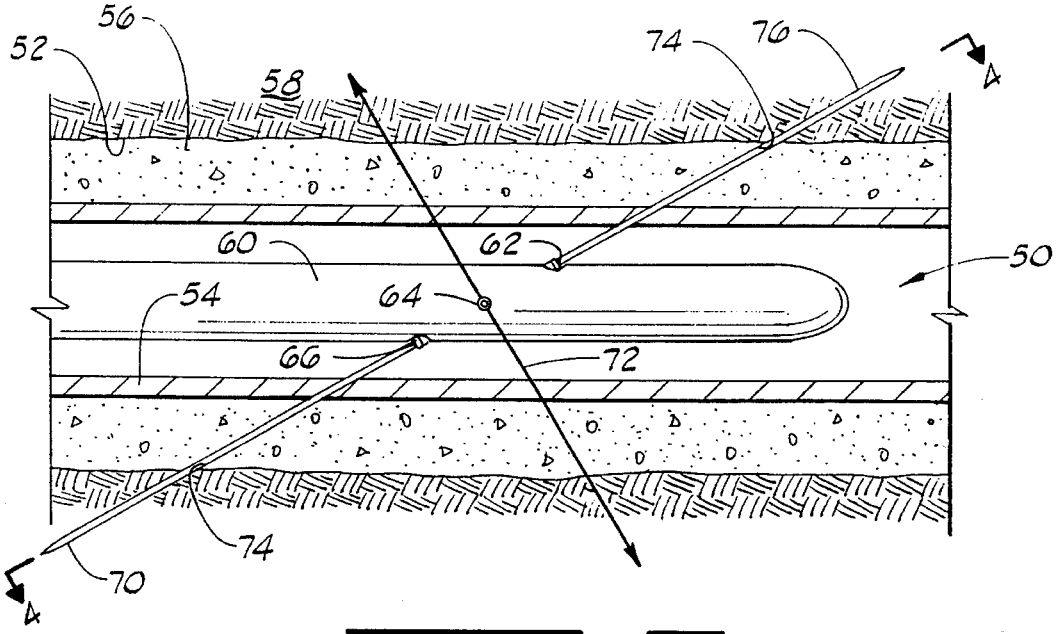
FIG. 3 illustrates the coplanar angular jetting head for well perforating of the present invention shown in position in a substantially horizontal portion of a deviated well.

Referring now to FIG. 3, the coplanar angular jetting head of the present invention is shown and generally designated by the numeral 50. As with the prior art jetting tool 22 previously described, jetting head 50 is positioned in a well bore 52. Well bore 52 has a casing string 54 disposed therein which is cemented in place by cement 56. Well bore 52 as illustrated is a substantially horizontal portion of a deviated well which intersects a subterranean formation 58, although the invention is not limited to this application. It will be understood that "deviated" wells include those without horizontal sections. "Horizontal" wells are just a specific type of "deviated" well.

Figure 4:
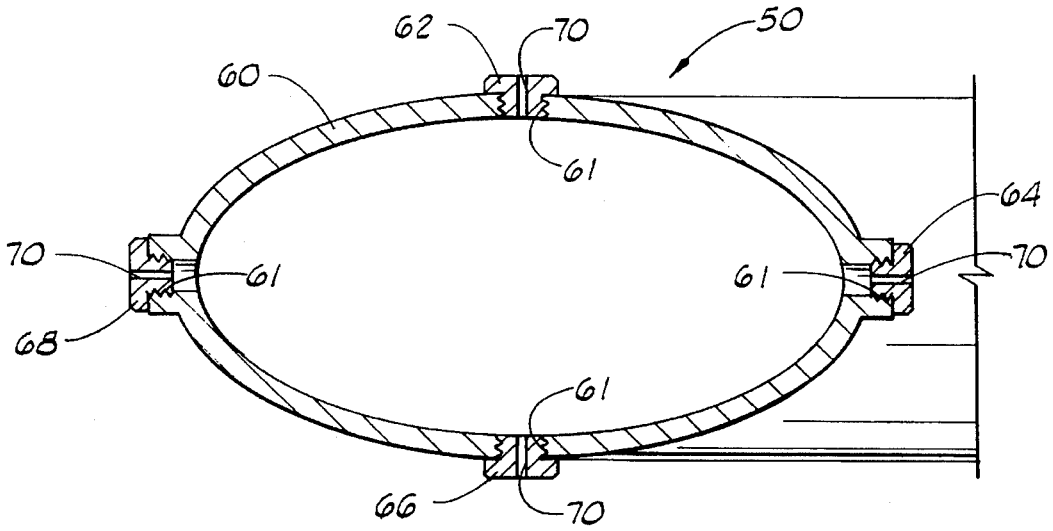
FIG. 4 is a cross section taken along lines 4—4 in FIG. 3.

Referring also to FIG. 4, jetting head 50 includes a housing 60 with a plurality of jetting openings 61 therein. In each jetting opening 61 is a jetting nozzle, such as 62, 64, 66 and 68. Jetting nozzles 62, 64, 66 and 68 are attached to housing 60 by any means known in the art, such as the illustrated threaded engagement. Each jetting nozzle 62, 64, 66 and 68 has an orifice 70 defined therein through which the jetting fluid is jetted.

It will be seen that all of nozzles 62, 64, 66 and 68 are coplanar. That is, they are all disposed on a single plane which is in angular relationship to the longitudinal axis of jetting head 50. Ideally, the plane of jetting nozzles 62, 64, 66 and 68 is substantially perpendicular to the least principal stress axis 72 of formation 58. In this way, jetting tool 50 is used to jet a plurality of jetted holes 74 which are also substantially coplanar. These holes 74 in turn cause substantially coplanar fractures 76 to occur. It will be seen by those skilled in the art that fractures 76 are on the plane of maximum principal stress. This results in a consistent and even fracture formation which does not have the turns of the prior art methods and therefore eliminates, or at least greatly minimizes, the problem of tortuosity.

In the first embodiment of FIG. 4, all of jetting nozzles 62, 64, 66 and 68 are radially disposed from the central axis of housing 60. That is, the direction of each of jetting nozzle originates from the center of jetting head 50.

Figure 5:
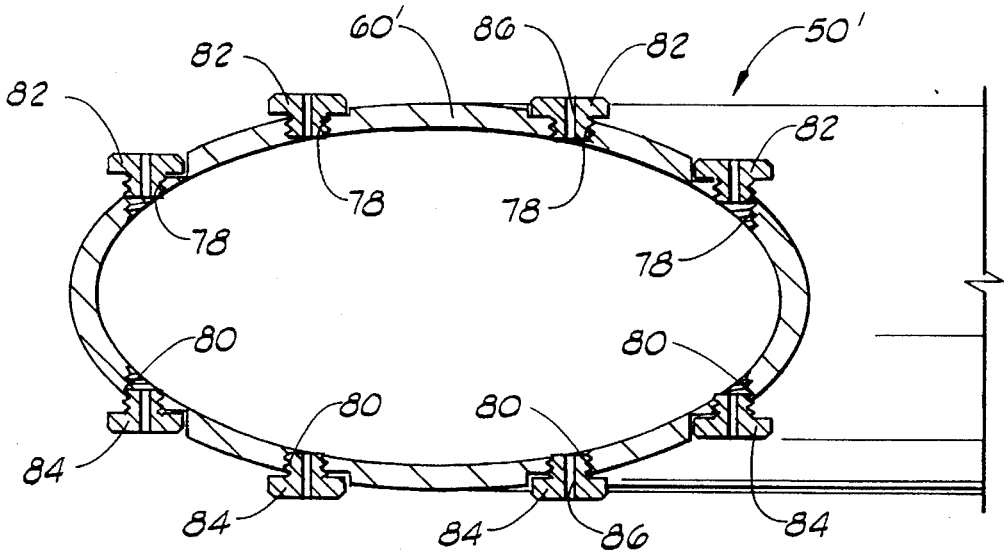
FIG. 5 shows a cross section of an alternate embodiment also taken along lines 4—4 in FIG. 3.

Referring now to FIG. 5, a second embodiment jetting head 50' is shown which comprises a housing 60' with two sets of jetting openings 78 and 80 defined therein facing in opposite directions. In this embodiment, there are two sets of substantially coplanar jetting nozzles 82 disposed in jetting openings 78 and jetting nozzles 84 disposed in jetting openings 80. Jetting nozzles 82 and 84 have orifices 86 therein and may be attached to housing 60' by any means known in the art, such as the threaded engagement illustrated.

The orientation of jetting nozzles 82 and 84 in second embodiment jetting head 50' differ from that of first embodiment jetting head 50 in that the direction of the jetting nozzles in the second embodiment do not all originate from the center of the jetting head. As illustrated in FIG. 5, each of jetting nozzles 82 is substantially parallel and coplanar, and they are positioned such that jetting nozzles 82 make a cutting angle that is the steepest possible at the contact point in the casing. This greatly increases cutting efficiency through the casing wall. This in turn results in better fracture formation extending from a corresponding parallel plurality of jetted holes. Jetting nozzles 84 are similarly disposed, but generally face in the opposite direction from nozzles 82.

The number and orientation of jetting nozzles 82 and 84 may be varied as desired depending upon the well formation, so long as they are coplanar. The plane on which the jetting nozzles are coplanarly disposed may also be varied to correspond to the angle of the axis of least principal stress so that the plane is substantially perpendicular to that axis.

Figure 7:
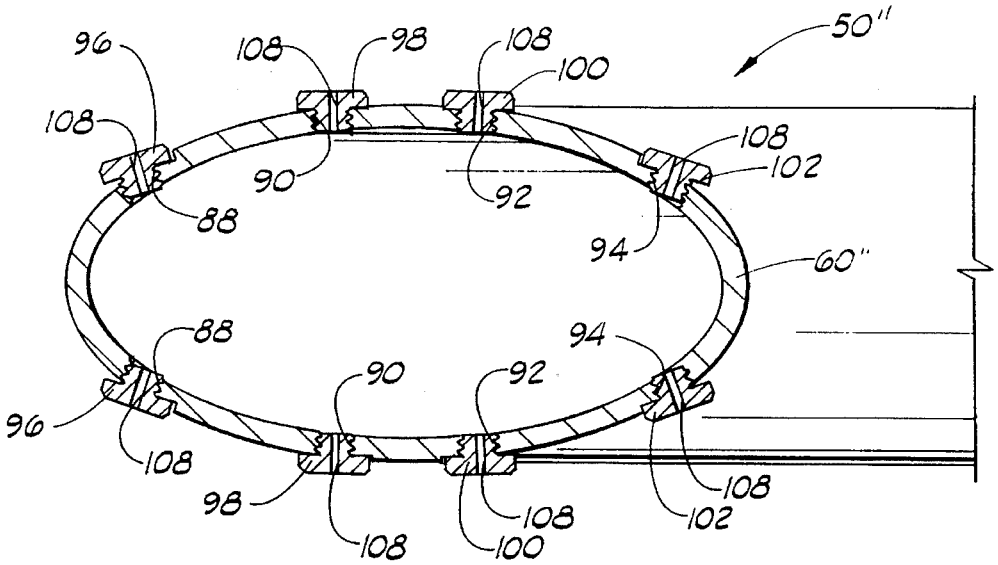
FIG. 7 is a cross section taken along lines 7—7 in FIG. 6.

Referring now to FIGS. 6 and 7, a third embodiment jetting head 50" is shown which comprises a housing 60" with a plurality of jetting openings 88, 90, 92 and 94 defined on one side thereof, and a substantial identical set of jetting openings 88, 90, 92 and 94 disposed on an opposite side thereof. A plurality of coplanar jetting nozzles 96, 98, 100 and 102 are disposed in each set of jetting openings 88, 90, 92 and 94, respectively. As best seen in FIG. 6, jetting nozzles 96, 98, 100 and 102 lay in a cut plane 104. Cut plane 104 is disposed at an angle 106 with respect to a substantially vertical plane 107 perpendicular to the axis of the well bore.

Jetting nozzles 96, 98, 100 and 102 have orifices 108 defined therein, and the jetting nozzles may be attached to housing 60" by any means known in the art, such as the threaded engagement illustrated.

Third embodiment jetting head 50" is similar to jetting head 50' except that jetting nozzles 96, 98, 100 and 102 are not parallel to one another as are the jetting nozzles in the second embodiment. The orientation of jetting nozzles 96, 98, 100 and 102 is mathematically calculated as a function of cut plane angle 106, the outside diameter of jetting tool 50" and the inside diameter of casing string 54.

Figure 8:
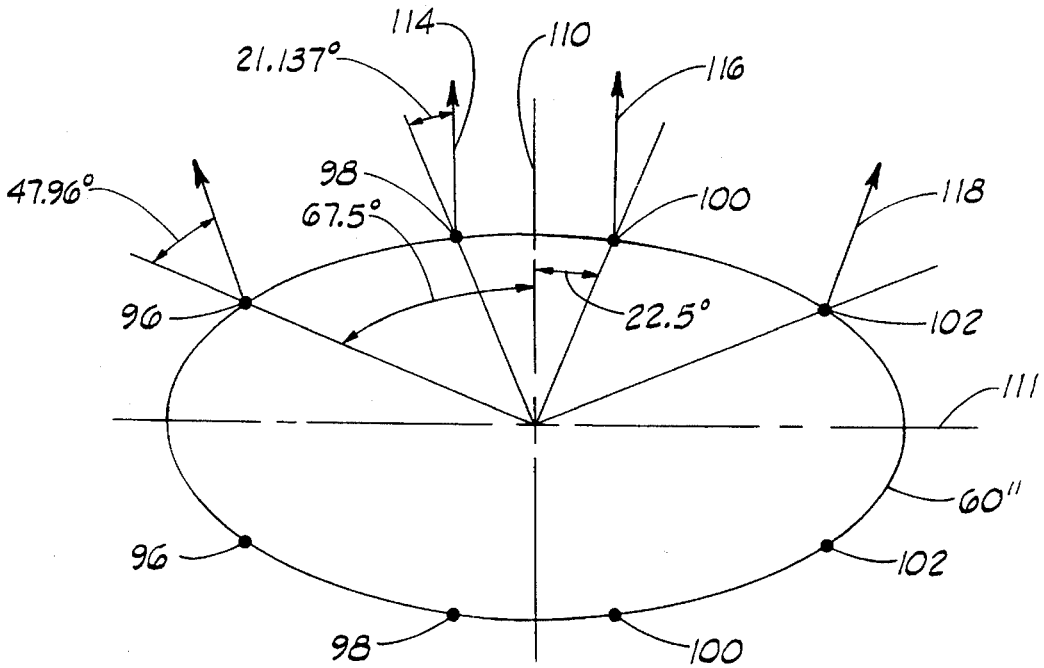
FIG. 8 is a schematic version of FIG. 7 illustrating a specific example of the apparatus with divergent nozzles.
Figure 8:
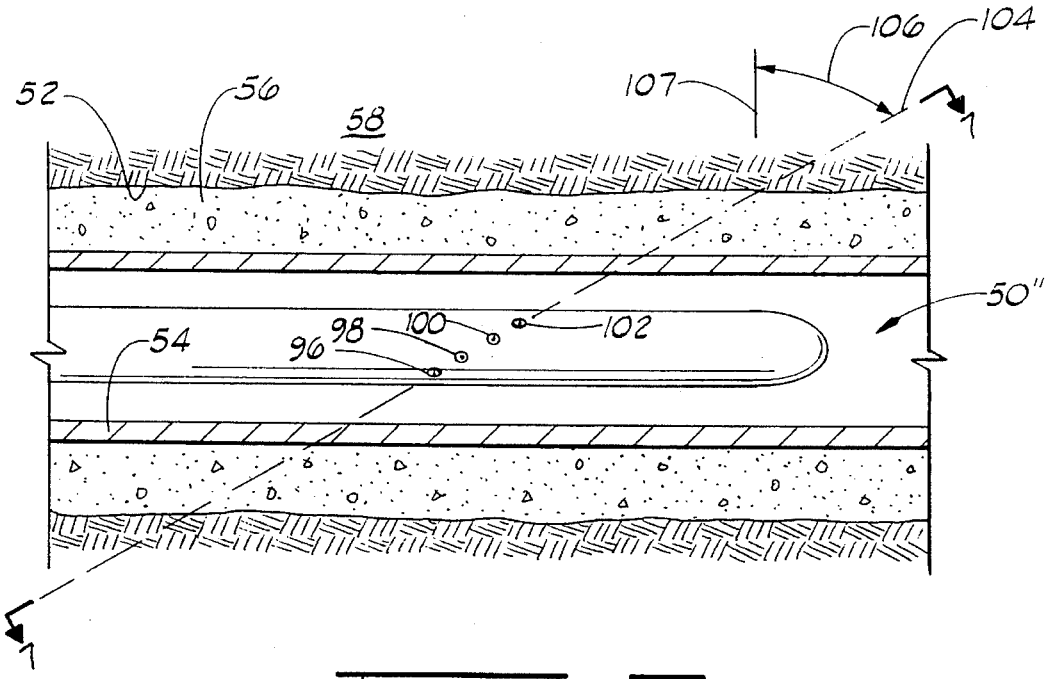

Referring also to FIG. 8, the orientation of jetting nozzles 96, 98, 100 and 102 will be discussed. Basically, FIG. 8 is a schematic version of FIG. 7 in which the jetting nozzles are indicated by points on an ellipse representing a section through housing 60".

Jetting nozzles 96, 98, 100 and 102 are equally angularly spaced. Therefore, for a total of eight jetting nozzles, the jetting nozzles are 45° apart. Preferably, jetting nozzles 98 and 100 are located at a 22½° angle from minor axis 110 of the ellipse, and jetting nozzles 96 and 102 are thus 67½° from the minor axis. This gives two sets of jetting orifices generally facing in opposite directions from major axis 111.

In the following example, angle 106 is approximately 60°, the outside diameter of jetting tool 50" is approximately four inches and the inside diameter of casing string 54 is approximately five inches. In FIG. 8, the jetted spray from nozzles 96, 98, 100 and 102 are designated by arrows 112, 114, 116 and 118, respectively. By mathematical calculation to achieve the steepest possible angle of contact with casing string 54, the preferred angle of jetting nozzles 98 and 100 is approximately 21.137° from a line extending through the jetting nozzle and the center line of the ellipse toward minor axis 110. It will thus be seen in FIG. 8 that jetting nozzles 98 and 100 will direct slightly divergent jetting streams 114 and 116 therefrom, respectively.

Also by mathematical calculation to achieve the steepest possible angle of contact with casing string 54, the preferred angle of jetting nozzles 96 and 102 is approximately 47.96° from a line through the center of the nozzle and the center of the ellipse toward minor axis 110. The maximum angle of contact for jetting nozzles 98 and 100 for this example is approximately 53° from vertical.

Those skilled in the art will thus see that nozzles 96 and 102 diverge from one another, nozzles 96 and 98 diverge from one another, and nozzles 100 and 102 diverge from one another. That is, the jetted streams 112, 114, 116 and 118 are not parallel to one another as in the second embodiment, but rather all diverge slightly.

In this example, the cutting angle is the steepest possible for each jetting nozzle at the contact point of the jetted fluid with casing string 54. This greatly increases cutting efficiency through the casing wall and results in better fracture formation extending from the jetted holes.

With this mathematically calculated embodiment, the number and orientation of jetting nozzles may be varied, thus resulting in a variation in the angular location of the jetting nozzles around the elliptical cross section through the housing with a corresponding variation in the angles of divergence of the jetted streams. As with the other embodiments, the main requirement is that all of the jetting nozzles are coplanar.

It will be seen, therefore, that the coplanar angular jetting head for well perforating of the present invention is well adapted to carry out the ends and advantages mentioned, as well as those inherent therein. While presently preferred embodiments of the apparatus and method of use have been described for the purposes of this disclosure, numerous changes in the arrangement and construction of parts in the apparatus and steps in method may be made by those skilled in the art. All such changes are encompassed within the scope and spirit of the appended claims.

What is claimed is:

1. A jetting apparatus for use in perforating a well bore, said apparatus comprising a housing defining a plurality of jetting openings therein, said jetting openings being substantially in a single plane which is disposed at an angle other than perpendicular with respect to a longitudinal axis of said housing, such that fluid is jetted in said plane from said jetting openings.

2. The apparatus of claim 1 wherein each of said jetting openings has a jetting nozzle disposed therein.

3. The apparatus of claim 1 wherein the angle of said plane is such that said plane may be positioned substantially perpendicular to an axis of least principal stress in a well formation adjacent to the well bore when said housing is disposed in said well bore.

4. The apparatus of claim 1 wherein said openings are angularly disposed on said plane.

5. The apparatus of claim 1 wherein said openings are oriented in directions which substantially originate from said longitudinal axis.

6. The apparatus of claim 1 wherein the direction of at least some of said openings originates from a direction spaced from said longitudinal axis.

7. The apparatus of claim 6 wherein at least some of said openings are substantially parallel.

8. The apparatus of claim 1 wherein said jetting openings are disposed at the steepest possible angle with respect to the well bore when said housing is disposed in said well bore.

9. A method of fracturing a well formation comprising the steps of:

selecting a jetting head with a plurality of fluid jets positioned in a single plane at an angle other than perpendicular with respect to a longitudinal axis of said jetting head;

positioning said jetting head in a well bore; and directing fluid from said plurality of fluid jets on said jetting head in said plane at an angle other than perpendicular with respect to a longitudinal axis of said well bore.

10. The method of claim 9 wherein said angle is substantially perpendicular to a plane of least principal stress in the well formation.

11. The method of claim 9 wherein said fluid jets are directed from locations angularly disposed on said plane.

12. The method of claim 11 wherein at least one of said fluid jets is oriented in a direction which substantially intersects said longitudinal axis.

13. The method of claim 9 wherein at least some of said fluid jets are substantially parallel.

14. The method of claim 9 wherein said angle is the steepest possible at the contact point in said well bore.

15. The method of claim 9 wherein said fluid jets are directed from jetting nozzles disposed in said jetting head.

* * * * *